US006266892B1

(12) United States Patent
Haynie

(10) Patent No.: US 6,266,892 B1
(45) Date of Patent: Jul. 31, 2001

(54) DEVICE FOR ENHANCING REMOVAL OF LIQUID FROM FABRIC

(75) Inventor: Dan Haynie, North Logan, UT (US)

(73) Assignee: Concept Cleaning Systems, Inc., North Logan, UT (US)

( * ) Notice: Subject to any disclaimer, the term of this patent is extended or adjusted under 35 U.S.C. 154(b) by 0 days.

(21) Appl. No.: 09/617,376

(22) Filed: Jul. 17, 2000

Related U.S. Application Data

(63) Continuation-in-part of application No. 09/356,782, filed on Jul. 19, 1999.

(51) Int. Cl.[7] ..... F26B 21/06

(52) U.S. Cl. ..... 34/84; 34/85; 34/95.1; 34/633; 34/635; 34/638; 34/229

(58) Field of Search ..... 34/443, 444, 448, 34/84, 85, 618, 623, 633, 635, 638, 229, 92

(56) References Cited

U.S. PATENT DOCUMENTS

| | | | |
|---|---|---|---|
| 1,016,435 | | 2/1912 | Overholt . |
| 1,601,774 | | 10/1926 | Scheffer . |
| 2,219,802 | | 10/1940 | Bjorkman . |
| 2,799,040 | | 7/1957 | Hageal . |
| 3,169,843 | | 2/1965 | Campbell . |
| 3,375,540 | | 4/1968 | Hyde . |
| 3,619,848 | | 11/1971 | Salzmann . |
| 3,624,668 | | 11/1971 | Krause . |
| 3,697,771 | | 10/1972 | Colt . |
| 3,701,343 | | 10/1972 | Bowers . |
| 3,708,824 | | 1/1973 | Holubinka . |
| 3,761,997 | | 10/1973 | Frazier . |
| 3,950,815 | | 4/1976 | Fukuchi et al. . |
| 4,000,538 | | 1/1977 | Tissier . |
| 4,013,039 | | 3/1977 | Kubilius et al. . |
| 4,182,001 | | 1/1980 | Krause . |
| 4,264,999 | | 5/1981 | Monson . |
| 4,270,238 | | 6/1981 | Shallenberg et al. . |
| 4,308,636 | | 1/1982 | Davis . |
| 4,339,840 | | 7/1982 | Monson . |
| 4,345,996 | | 8/1982 | Lindman et al. . |
| 4,391,017 | | 7/1983 | Bruensicke . |
| 4,441,229 | | 4/1984 | Monson . |
| 4,675,935 | | 6/1987 | Kasper et al. . |
| 4,677,705 | | 7/1987 | Schuster . |
| 4,692,959 | | 9/1987 | Monson . |
| 4,862,551 | | 9/1989 | Martinez et al. . |
| 4,922,572 | | 5/1990 | Kohl et al. . |
| 4,945,939 | | 8/1990 | Maxwell et al. . |
| 4,968,166 | | 11/1990 | Ingram . |
| 5,213,263 | | 5/1993 | Corona . |
| 5,463,791 | | 11/1995 | Roden . |
| 5,485,651 | | 1/1996 | Payeur . |
| 5,555,595 | | 9/1996 | Ligman . |
| 5,593,091 | | 1/1997 | Harris . |
| 5,647,391 | | 7/1997 | Chan et al. . |
| 5,655,255 | * | 8/1997 | Kelly ..... 15/322 |

* cited by examiner

*Primary Examiner*—Pamela A Wilson
(74) *Attorney, Agent, or Firm*—Thorpe North & Western, LLP

(57) ABSTRACT

A device for enhancing removal of liquid from fabric, such as a vacuum head device for removing liquid from carpet, includes an elongated base plate to be moved across the carpet. The vacuum head has a tapering cross section with a wider upper end and a narrower lower end configured to penetrate into the carpeted surface. In addition, a plurality of apertures are formed in an array in the base plate to withdraw the fluid under a vacuum force. Preferably, the plurality of apertures are sized larger than a width of the lower surface to create a plurality of protrusions extending from the base plate configured to penetrate the carpeted surface.

23 Claims, 5 Drawing Sheets

| $H_2O$ | CFM | AIRWATTS |
|---|---|---|
| 3.3 | 95.3 | 36.91 |
| 5.6 | 94.1 | 61.84 |
| 9.9 | 91.4 | 106.19 |
| 18.9 | 87.4 | 193.85 |
| 26.8 | 83.9 | 263.86 |
| 37.8 | 78.3 | 347.33 |
| 52.1 | 70.2 | 429.20 |
| 67.6 | 58.5 | 464.07 |
| 82.4 | 44.7 | 432.23 |
| 96.3 | 30.8 | 348.06 |
| 109.6 | 18.5 | 287.94 |
| 121.2 | 8.9 | 126.58 |
| 136 | 0 | 0 |

DEVICE FOR ENHANCING REMOVAL OF LIQUID FROM FABRIC

This application is a continuation-in-part of co-pending U.S. application Ser. No. 09/356,782, filed Jul. 19, 1999.

BACKGROUND OF THE INVENTION

1.The Field of the Invention

The present invention relates generally to a device for increasing the efficiency of a carpet cleaning machine and other extraction machines in removing cleaning solution and other liquids from fabric, such as carpet. More particularly, the present invention relates to an improved vacuum head for penetrating carpet.

2. The Background Art

Carpet-cleaning machines spray a cleaning solution onto a fabric or carpet and then vacuum the solution from the carpet into the machine. Other extraction machines may spray a liquid onto a fabric or simply remove a pre-existing liquid from the fabric.

Carpet cleaning machines typically include a wand with a cleaning head that is movable over the carpet, or a rotating platform that rotates one or more cleaning heads over the carpet. The cleaning heads usually include a spray nozzle for spraying a liquid, such as a cleaning solution, onto and/or into the carpet. In addition, the cleaning heads usually include a vacuum head for vacuuming or sucking the fluid, and any dirt, from the carpet. The vacuum heads commonly include a large opening, such as with an inverted funnel, which sits and moves atop the carpet. vacuuming or sucking the fluid, and any dirt, from the carpet. The vacuum heads commonly include large opening, such as with an inverted funnel, which sit and move atop the carpet.

One disadvantage with many vacuum heads is their inefficiency. Some vacuum heads remove less than 20% of the fluid. It will be appreciated that the fluid remaining in the carpet renders the carpet wet, and thus off limits for many hours while the carpet dries. In addition, it will be appreciated that a significant amount of dirt remains in the carpet with the remaining fluid.

SUMMARY OF THE INVENTION

It has been recognized that it would be advantageous to develop a device for increasing the efficiency of carpet cleaning machines, and other extraction machines. In addition, it has been recognized that it would be advantageous to develop an improved vacuum head for removing a greater amount of fluid from carpet.

The invention provides a vacuum head device for attachment to the bottom of a wand or other nozzle that is used to vacuum liquid, especially liquid cleaning solution, from fabric, such as a carpet. The device includes an elongated base plate to be moved on the carpeted surface. The base plate can have a tapering cross section with a wider upper end and a narrower lower end to penetrate into the carpeted surface. In addition, the base plate includes a plurality of apertures formed in an array in the base plate to withdraw the fluid under a vacuum force.

In accordance with one aspect of the present invention, the plurality of apertures can be sized larger than a width of a lower surface of the base plate to create a plurality of protrusions. The protrusions extend from the base plate to penetrate the carpeted surface.

In accordance with another aspect of the present invention, a plurality of channels can be formed in the lower end of the base plate, and each extend from the forward surface to one of the plurality of apertures. The channels can channel the fluid to the apertures.

In accordance with another aspect of the present invention, the device may further employ two mechanical concepts and two aerodynamic techniques to enhance the extraction of the liquid from the fabric.

Additional features and advantages of the invention will be set forth in the detailed description which follows, taken in conjunction with the accompanying drawing, which together illustrate by way of example, the features of the invention.

DETAILED DESCRIPTION

Figure 1:
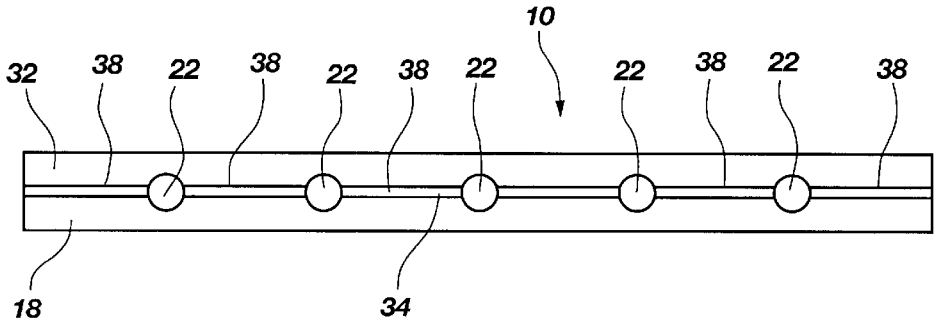
FIG. 1 is a bottom view of a base plate of the vacuum head in accordance with the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

As illustrated in FIGS. 1–3 and 6–10, a vacuum head device, indicated generally at 10, in accordance with the present invention is shown for removing liquid from fabric, such as carpet. Carpet cleaning and carpet cleaning machines are examples of fields which may benefit from use of such a device. The vacuum head device 10 can be used to withdraw a fluid from a carpeted surface 14. Such a device 10 can be constructed initially in a carpet cleaning machine or other machine, or it can be attached to existing such machines.

The device 10 includes a base plate 18 with one or more apertures 22 which serve as extraction nozzles to remove liquid from a fabric or carpet 14 when the device 10 has been built into or retrofitted on a vacuum machine, such as a carpet-cleaning machine. The base plate 18 preferably is elongated and movable on or through the carpeted surface 14. The one or more apertures 22 are formed in the base plate 18 and withdraw fluid under a vacuum force supplied by the machine, as is well known in the art.

The base plate 18 advantageously can have a tapering cross section with a wider upper end 26 and a narrower lower end 30. The cross section of the base plate 18 can be V-shaped, with an angled forward surface 32. The narrow lower end 30 advantageously is better able to penetrate into the carpeted surface 14, and thus locate the apertures 22 closer to the bottom of the carpeted surface 14, and the fluid. The lower end 30 can be rounded to facilitate movement through the carpet.

In addition, the one or more apertures 22 advantageously includes a plurality of apertures formed in an array along the length of the base plate 18. The array of apertures 22 can be linearly aligned, as shown. The plurality of apertures 22 preferably are formed at the lower end 30 of the base plate 18, such that the apertures 22 can be located closer to the fluid at the bottom of the carpeted surface 14.

The base plate 18 has a lower surface 34 at the lower end 30 with a width. The apertures 22 preferably have a diameter or size larger than the width of the lower surface 34, thus creating a plurality of protrusions or barriers 38 between the apertures 22 extending from the base plate 18 to penetrate the carpeted surface 14. The protrusions or barriers 38 advantageously force any liquid in the carpeted surface 14 toward the apertures 22 as the base plate 18 is moved across the carpeted surface 14. In addition, the narrower end 30 and protrusions or barriers 38 advantageously penetrate into the carpeted surface 14 to reach the fluid.

The protrusions or barriers 38 may have a total surface area located between the apertures 22 which is less than a total area of the apertures 22. In addition, each of the protrusions 38 may have a width between the apertures 22 which is less than a width or diameter of the apertures 22.

In addition, the base plate 18 can include one or more channels 42 formed in the lower end 30. The channels 42 extend from the forward surface 32 to corresponding apertures 22. The channels 42 allow fluid to flow into the apertures 22.

The protrusions or barriers 38 can be attached to the bottom or lower end 30 of the base plate 18, which is the portion of the base plate 18 that will face and contact the carpet, and are preferably an integral part of the base plate 18. These barriers 38 can be oriented and shaped in any fashion that will force any liquid in the fabric toward the apertures 22 as the base plate 18 is moved across the fabric. For a machine that will generally be moved straight forward and straight reverse across a carpet, the barriers 38, as viewed from below, preferably have a straight, elongated shape, as illustrated in FIG. 1.

The barriers 38 are preferably generally located between apertures 22, preferably between adjacent apertures 22, as depicted in FIG. 1.

The liquid tends to go laterally rather than further into the fabric for two reasons: first, the fabric is denser under the barriers 38 because the barriers 38 are, in use, pressed against the fabric and, second, a vacuum is applied through the apertures 22.

Figure 2:
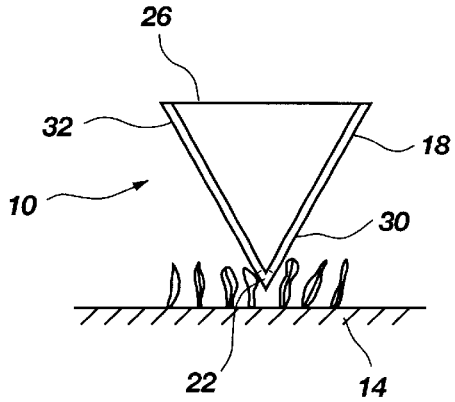
FIG. 2 is an end view of the base plate of the vacuum head of FIG. 1.
Figure 3:
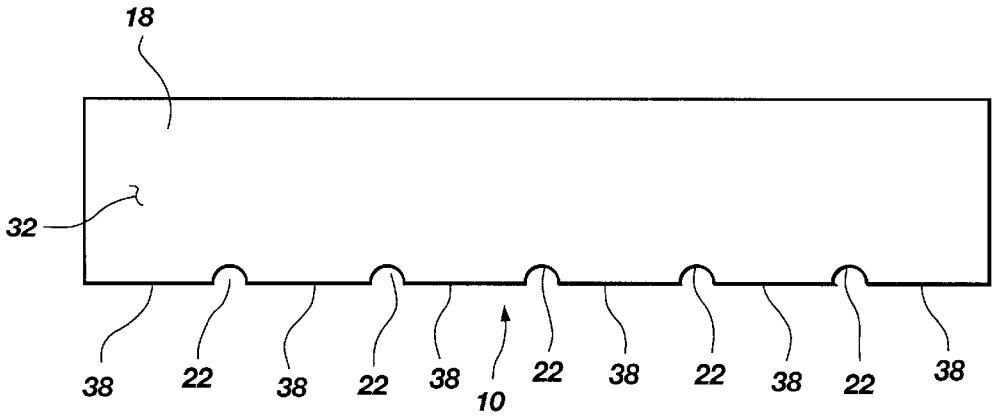
FIG. 3 is a front view of the vase plate of the vacuum head of FIG. 1.

The construction of the barriers 38 is such that each barrier 38 has only a small surface area that will contact the fabric generally perpendicularly to the original orientation of such fabric. A preferred shape for a barrier 38, as viewed from either end of the barrier 38, to be used with a machine that will generally be moved straight forward and straight reverse across a fabric is a V-shape which is preferably integrally formed with the base plate 18, which is also preferably V-shaped when viewed from either end, as shown in FIG. 2. The view of this preferred shape for the barrier 38 and the base plate 14 from either in front of the base plate 14 or behind the base plate 14 is given in FIG. 3.

Figure 4:
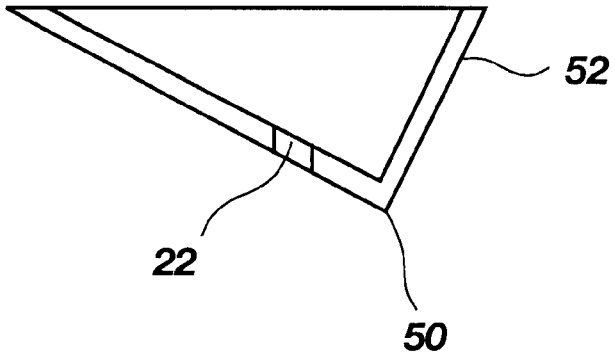
FIG. 4 is an end view of another base plate of a vacuum head in accordance with the present invention.

Optionally, barriers 50 can be located behind the apertures 22, as portrayed in FIG. 4. In such a case, a single barrier 50 preferably runs behind all the apertures 22. Having a barrier 50 located behind the apertures 22, with respect to the intended direction of movement for a base plate 52, tends further to increase the probability that liquid will be drawn into the apertures 22 because an aperture 22 will not simply pass over the liquid; by the barrier 50 forcing the liquid to move with the aperture 22 as part of the process of forcing the liquid toward such aperture 22 the liquid will be retained for a longer period of time under the aperture 22 to which a vacuum is being applied.

Figure 5:
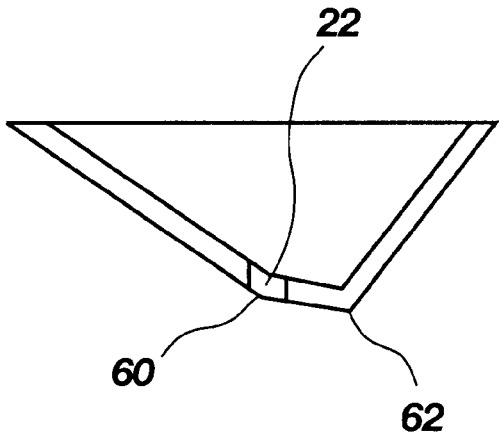
FIG. 5 is an end view of another base plate of a vacuum head in accordance with the present invention.
Figure 6:
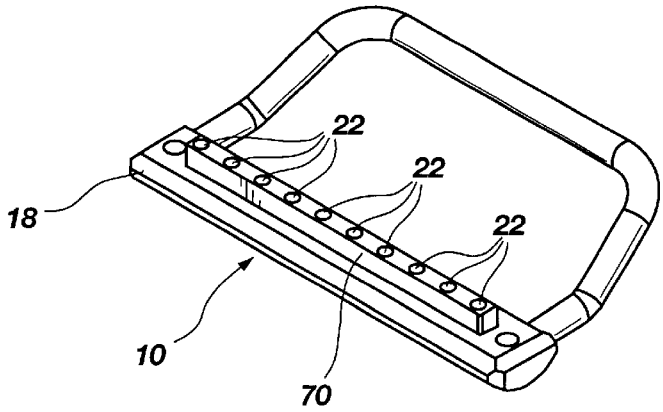
FIG. 6 is a perspective view of a base plate of a vacuum head in accordance with the present invention.
Figure 7:
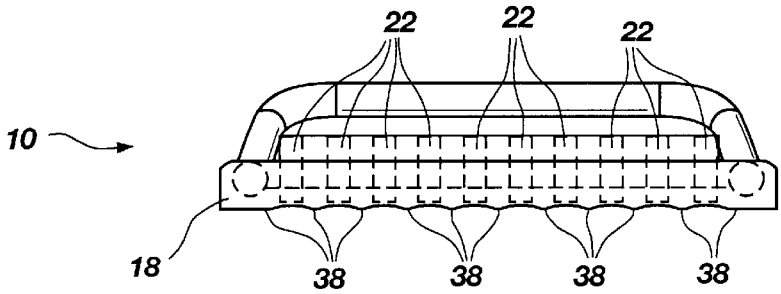
FIG. 7 is a front view of the base plate of the vacuum head of FIG. 6.
Figure 8:
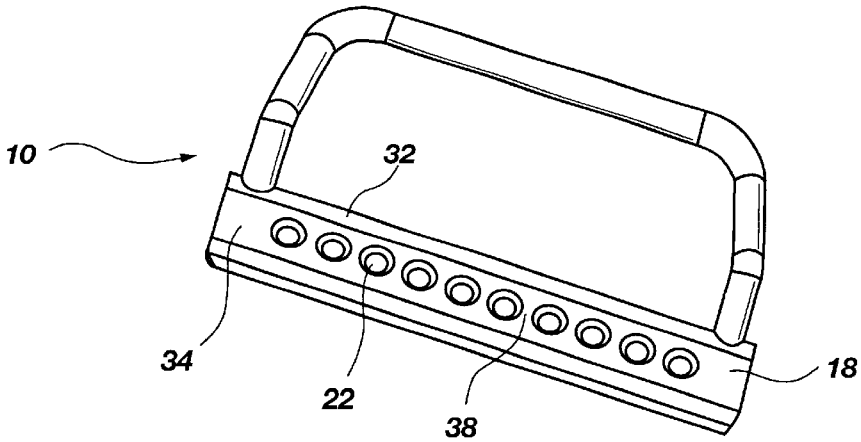
FIG. 8 is a bottom view of the base plate of the vacuum head of FIG. 6.
Figure 9:
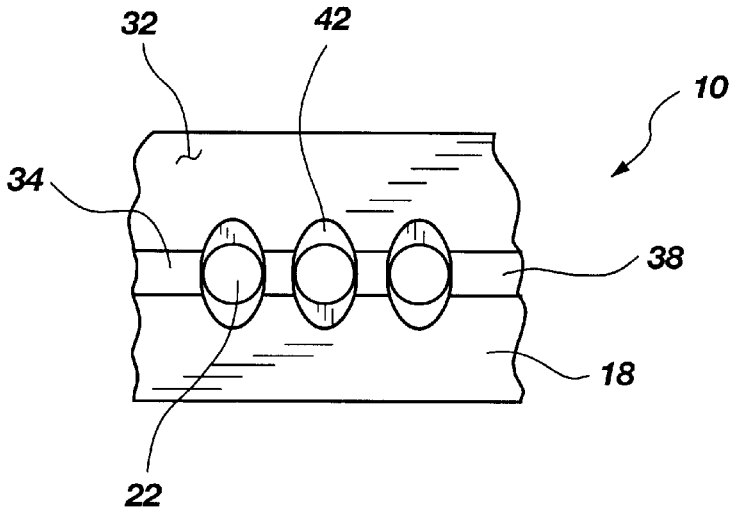
FIG. 9 is a partial bottom view of the base plate of the vacuum head of FIG. 6.
Figure 10:
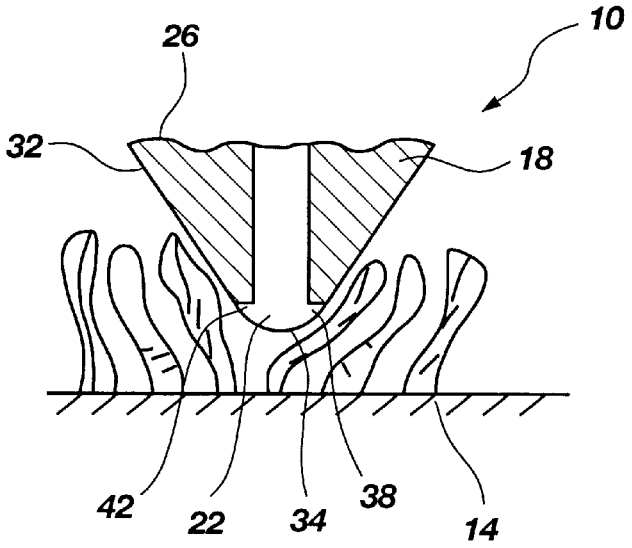
FIG. 10 is a cross-sectional end view of the base plate of the vacuum head of FIG. 6.

A further optional embodiment, which is illustrated in FIG. 5, has barriers 60 and 62 both generally between the apertures 22 and also behind the apertures 22.

As indicated above, the device 10 may employ two mechanical concepts and two aerodynamic techniques to enhance extraction of the liquid from the carpet. First, concerning the mechanical concepts, the apertures or barriers are attached to the portion of the device that will contact the fabric so that such barriers, when force is applied to the device, will extend farther into the fabric than any other portion of the device. These barriers can be oriented and shaped in any fashion that will push any liquid in the fabric toward extraction nozzles as the device is moved across the fabric, in a manner similar to the way that a snow plow pushes snow ahead and to the side of the plow.

Second, concerning the mechanical concepts, since pressure is equal to force divided by the component of surface area that applies such force and that is perpendicular to the body to which force is applied, the pressure exerted by the device upon fabric is increased by decreasing the surface area of the device that contacts the fabric.

The extraction nozzles are apertures in the only portion of the device, other than the barriers, that will, when the device is used, face and contact the fabric and are generally located between the barriers. The existence of such apertures, therefore, decreases the surface area of the device that will contact the fabric.

The fact that, when force is applied to the device, the barriers extend farther into the fabric than any other portion of the device is also employed to further increase the pressure that the device exerts, for a given force, against the fabric since such barriers are constructed to have only a small surface area which contacts the fabric generally perpendicularly to the original orientation of such fabric.

Thus, the existence of the apertures and the construction of the barriers combine to increase the pressure that is exerted against a fabric when a given force is applied to the device and, therefore, to increase the penetration of the device into the fabric. Such increased penetration enhances the removal of any liquid in the fabric.

Figure 11:
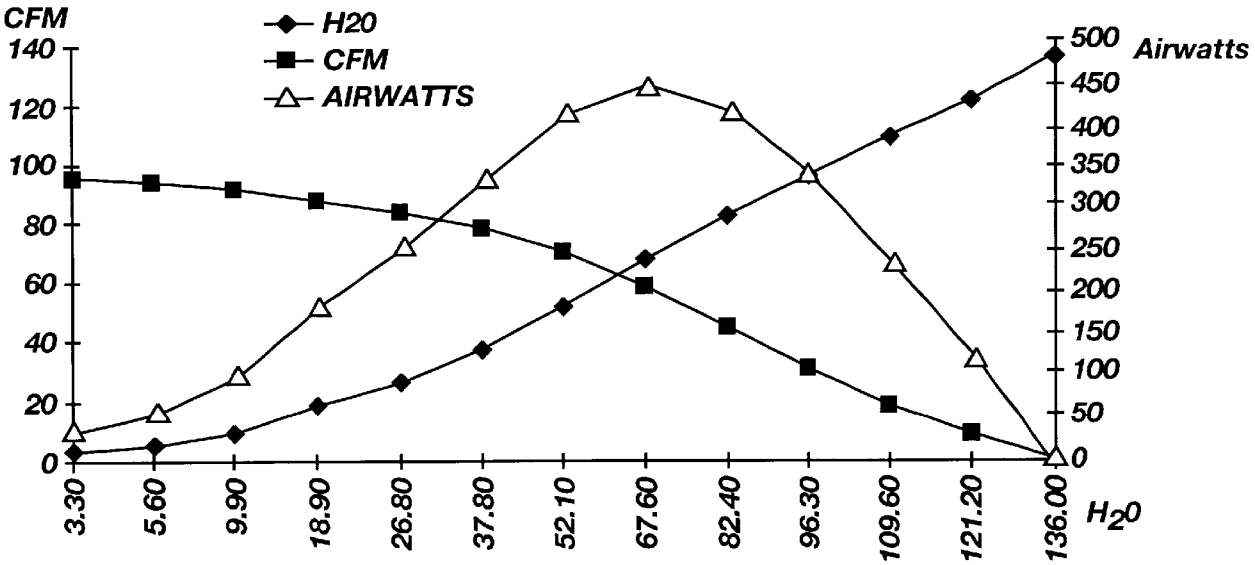
FIG. 11 is an exemplary graph showing the relationship between airwatts, mass airflow, and pressure.

Referring to FIG. 11, with respect to the first aerodynamic technique, the usable energy or power of an extraction airstream produced by a vacuum motor is a function of the mass airflow (CFM) versus velocity (pressure) and is expressed in SI units as airwatts. Per ASTM F558-95, the equation for this unit derives to:

Airpower (airwatts)=11735 (diff pressure in $H_2O$) (flowrate in CFM)

In centrifugal blowers, airstream energy, and thus airwatts, typically peak where the CFM versus $H_2O$ curves intersect. As a result, running a blower close to this intersecting pressure range should result in the crested amount of useful energy in which to perform work such as moisture extraction. The system needs to be "tuned" (hose length/size, nozzle opening, etc.) to ensure this is the case.

The second aerodynamic technique is reducing, and preferably minimizing, the boundary layer drag in the extraction nozzles. This is accomplished by reducing, and preferably minimizing, the ratio of the total distance measured along the perimeters of the extraction nozzles to the total cross-sectional area of the extraction nozzles, which, consequentially, minimizes the surface of the extraction nozzles to which the stream of air is exposed.

For extraction nozzles having a circular or rectangular cross section, once the total cross-sectional area for the nozzles has been determined as discussed above, mathematically applying this second aerodynamic technique demonstrates that the greater the number of extraction nozzles for a given total cross-sectional area, the larger will be the requisite ratio and the boundary layer drag.

Finally, the cross-sectional area of each of the extraction nozzles is selected to be large enough to permit solid contaminants that can be expected to be in the liquid to pass through the extraction nozzles without clogging such nozzles. Since such contaminants are generally larger than the diameter of carpet fibers, application of this final concept also reduces the likelihood that carpet fibers will obstruct a nozzle.

Although the last two paragraphs considered alone would suggest that a single extraction nozzle would be preferable, experimental observations have demonstrated that better performance is achieved with multiple barriers and multiple apertures, provided the total cross-sectional area of the extraction nozzles has been selected to increase, and preferably maximize, the extraction power for the vacuum motor.

Thus, as a practical matter, the shape and number of extraction nozzles is determined empirically.

As discussed above, the existence of the apertures 22, and the fact that, when force is applied to the device 10, the barriers 38 extend farther into the fabric than any other portion of the device 10; and the construction of such barriers 38 to have only a small surface area which contacts the fabric generally perpendicularly to the original orientation of such fabric combine to decrease the surface areas of the device that will exert pressure on the fabric, i.e., the barriers 38 and the base plate 18, and thereby to increase the pressure and, consequently, the penetration of the barriers 38 and the base plate 18 achieved when a given force is applied to the device. Such increased penetration of the base plate 18 enhances the removal of any liquid in the fabric.

The total cross-sectional area of the apertures 22 is selected to be that which, as explained above, increases, and preferably maximizes, the energy content of air that moves through such apertures 22; this is accomplished by selecting the total of the aperture size for all apertures 22 combined to create the rate of air flow through the apertures 22 that will increase, and preferably maximize, the extraction power for the vacuum with which the device is to be utilized.

Additionally, the number and shape of the apertures 22 is selected to reduce boundary layer drag by reducing, and preferably minimizing, the ratio of the total distance measured along the perimeters of the apertures 22 to the total cross-sectional area of such apertures 22. This, as also explained above, minimizes the surface of the apertures 22 to which the stream of air is exposed.

Finally again as discussed above, the cross-sectional area of the apertures 22 is selected to be large enough to permit solid contaminants that can be expected to be in the liquid to pass through the apertures 22 without clogging these apertures 22. This is consistent with the other aerodynamic goals because, e.g., the ratio of the total distance measured along the perimeters of the apertures 22 to the total cross-sectional area of such apertures 22, when the apertures 22 are circles, is inversely proportional to the radius of such circles.

A commercially available system for placing a cleaning fluid on carpet and vacuuming the fluid from the carpet having a single rectangular aperture and no barriers was modified by inserting several embodiments of the vacuum head device having ten apertures 22 and between two and ten barriers of different lengths. The original system recovered 17.81 percent of the cleaning fluid that had been placed upon the carpet. The average recovery for the system modified to incorporate the three versions of the vacuum head device, one version at a time, of course, was 47.33 percent.

On the upper surface of the base plate 18 is located a projection 70 that surrounds the apertures 22. Only this projection 70 is inserted into the wand or other nozzle of the vacuum system. A gasket that is well known in the art is placed around the projection 70 to form a seal when the device is attached to the wand or other nozzle. The projection 70 prevents the gasket from inadvertently obstructing any aperture 22.

On the bottom 30 of the base plate 18, the apertures 22 can be countersunk to minimize the risk of snagging carpet fabric fibers and to assist in blending the stream of air that flows into each aperture 22.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A vacuum head device configured to withdraw a fluid from a carpeted surface, the device comprising:

a) an elongated base plate configured to be movably disposed on the carpeted surface, and having a tapering cross section with a wider upper end and a narrower lower end configured to penetrate into the carpeted surface; and b) a plurality of apertures, formed in an array in the base plate, configured to withdraw the fluid under a vacuum force.

2. A device in accordance with claim 1, wherein the base plate has a lower surface; and wherein the plurality of apertures are formed at the lower end, and sized larger than a width of the lower surface, creating a plurality of protrusions extending from the base plate configured to penetrate the carpeted surface.

3. A device in accordance with claim 2, wherein the protrusions have a total surface area between the apertures less than a total area of the apertures.

4. A device in accordance with claim 2, wherein each of the protrusions have a width between the apertures less than a width of the apertures.

5. A device in accordance with claim 1, wherein the cross section of the base plate is V-shaped, and the lower end is rounded.

6. A device in accordance with claim 5, wherein the plurality of apertures are disposed at a bottom of the V-shaped cross section.

7. A device in accordance with claim 1, wherein the base plate includes a forward surface; and further comprising:

at least one channel, formed in the lower end of the base plate and extending from the forward surface to the at least one aperture.

8. A vacuum head device configured to withdraw a fluid from a carpeted surface, the device comprising:

a) an elongated base plate configured to be movably disposed on the carpeted surface; and b) a plurality of apertures, formed in an array in the base plate, configured to withdraw the fluid under a vacuum force.

9. A device in accordance with claim 8, wherein the base plate has a tapering cross section with a wider upper end and a narrower lower end configured to penetrate into the carpeted surface.

10. A device in accordance with claim 9, wherein the cross section of the base plate is V-shaped, and the lower end is rounded.

11. A device in accordance with claim 10, wherein the plurality of apertures are disposed at a bottom of the V-shaped cross section.

12. A device in accordance with claim 9, wherein the base plate has a lower surface; and wherein the plurality of apertures are formed at the lower end, and sized larger than a width of the lower surface, creating a plurality of protrusions extending from the base plate configured to penetrate the carpeted surface.

13. A device in accordance with claim 12, wherein the protrusions have a total surface area between the apertures less than a total area of the apertures.

14. A device in accordance with claim 12, wherein each of the protrusions have a width between the apertures less than a width of the apertures.

15. A device in accordance with claim 8, wherein the base plate includes a forward surface; and further comprising:

a plurality of channels, formed in the lower end of the base plate and each extending from the forward surface to one of the plurality of apertures.

16. A vacuum head device configured to withdraw a fluid from a carpeted surface, the device comprising:

a) an elongated base plate configured to be movably disposed on the carpeted surface, and having a tapering cross section with a wider upper end and a narrower lower end configured to penetrate into the carpeted surface; and b) a plurality of apertures, formed in an array in the base plate, configured to withdraw the fluid under a vacuum force.

17. A device in accordance with claim 16, wherein the plurality of apertures are formed at the lower end.

18. A device in accordance with claim 16, wherein the base plate has a lower surface; and wherein the plurality of apertures are formed at the lower end, and sized larger than a width of the lower surface, creating a plurality of protrusions extending from the base plate configured to penetrate the carpeted surface.

19. A device in accordance with claim 18, wherein the protrusions have a total surface area between the apertures less than a total area of the apertures.

20. A device in accordance with claim 18, wherein each of the protrusions have a width between the apertures less than a width of the apertures.

21. A device in accordance with claim 16, wherein the cross section of the base plate is V-shaped, and the lower end is rounded.

22. A device in accordance with claim 21, wherein the plurality of apertures are disposed at a bottom of the V-shaped cross section.

23. A device in accordance with claim 16, wherein the base plate includes a forward surface; and further comprising:

a plurality of channels, formed in the lower end of the base plate and each extending from the forward surface to one of the plurality of apertures.

* * * * *